United States Patent [19]

Derain

[11] 4,150,472

[45] Apr. 24, 1979

[54] PROCESS FOR MANUFACTURING STAINLESS STEEL SINKS WHOSE TUBS OR DRAIN BOARDS ARE COLORED

[75] Inventor: Claude Derain, Paris, France

[73] Assignee: Eviers Denis, Feugerolles, France

[21] Appl. No.: 862,122

[22] Filed: Dec. 19, 1977

[30] Foreign Application Priority Data

Dec. 23, 1976 [FR] France ..... 76 39356

[51] Int. Cl.[2] ..... B23P 3/00; B23P 19/04; B23P 25/00

[52] U.S. Cl. ..... 29/458; 29/460; 4/187 R; 228/162

[58] Field of Search ..... 29/458, 460; 228/162; 4/187 R, 187 A, 189

[56] References Cited

U.S. PATENT DOCUMENTS

| | | | |
|---|---|---|---|
| 2,303,292 | 11/1942 | Heckathorn | 4/187 R |
| 2,427,299 | 9/1947 | Muerle | 29/460 |
| 2,456,065 | 11/1948 | Just | 4/187 R |
| 2,721,333 | 10/1955 | Stanitz | 4/189 |
| 3,226,807 | 1/1966 | Orr | 29/458 X |
| 3,360,847 | 1/1968 | Chick et al. | 29/458 X |
| 3,778,884 | 12/1973 | Bene | 4/187 A |
| 3,959,866 | 6/1976 | Biddle et al. | 29/458 X |

*Primary Examiner*—Charlie T. Moon

*Attorney, Agent, or Firm*—Haseltine, Lake & Waters

[57] ABSTRACT

A process for manufacturing a sink of stainless steel having a tub member connected integrally or by assembly with a plate member forming a drain board. The process comprises forming the members of stainless steel, one of the members being coated with an adherent color layer of abrasion resistant material. The tub member is joined to the plate member along a rounded annular connection region to which the color layer extends and the annular connection region is tangentially ground all along its length to form a chamfer providing a precise connection between the color layer on the coated member with the bare surface of the other member. In the case where the color layer is applied after the members are connected together, a removable mask is placed in the areas which are not to be coated. When the tub member and plate member are assembled together from separate units, such assembly can be effected by electrically welding the members together at the bare contacting surfaces.

14 Claims, 18 Drawing Figures

PROCESS FOR MANUFACTURING STAINLESS STEEL SINKS WHOSE TUBS OR DRAIN BOARDS ARE COLORED

FIELD OF THE INVENTION

The present invention relates to metallic sinks formed with one or two tubs assembled on a plate providing one or more drain boards, and to one-piece sinks directly obtained by stamping.

PRIOR ART

It is known to form metallic sinks which are internally colored with respect to a non-colored plate of stainless steel. Discloration of the tub is produced by the use of independent metallic tubs which are necessarily of ordinary steel in order to be able to be enameled along its internal convex surface. These enameled tubs are attached along their upper peripheral edge with respect to the rim of one or more openings in the plate called a "paillase" by peripheral clamping as shown in FIG. 1.

This attachment permits the covering of inherent imperfections in the enameling at the peripheral edges of the tubs while allowing a precise connection with respect to the opening of the plate.

This process, however, has a number of disadvantages. In fact, the enameling necessarily excludes attachment by electrical welding (which is more efficient) due to the presence of the enamel which forms an electrical insulator. The interior of the clamping assembly also provides an annular recess in which grease and waste can accumulate which is unhygienic. Finally, at the time of assembly, the enamel is very easily chipped and due to the use of tubs of ordinary steel, contact with water produces a rapid oxidation which leads to the formation of permanent rust spots and in time to the destruction of the tub.

SUMMARY OF THE INVENTION

An object of the invention is to provide a process for manufacturing sinks which overcomes these disadvantages, and the invention contemplates a process for fabrication of sinks having colored or non-colored tubs of stainless steel with colored or non-colored plates of stainless steel, the process being applicable to one-piece sinks or to sinks having connected tubs.

According to a first feature of the invention, a bare tub of stainless steel is directly secured lightly by its peripheral rim to the edge of a respective opening in the plate by electrical welding whereafter the interior surface of the tub then receives one or more colored layers of great adherence having high abrasion resistance. After the colored layers harden, a peripheral grinding operation is effected angularly and tangentially with respect to the rounded surface connected to the peripheral rim to form a chamfer with elimination of all excess metal from the extremity of the peripheral edge at the opening of the plate while effecting a perfect connection of the colored portion of the tub with the plate.

According to a modification, the tub of stainless steel is preliminarily coated on its interior surface with a colored layer and after drying of this layer, the peripheral edge of the tub is ground to expose the stainless steel and permit contact and bearing with the edge of the opening of the plate in order to provide electrical conductivity at the time of electrical welding. After welding, a peripheral grinding operation is effected to produce a chamfer which eliminates all excess metal and provides a perfect connection of the colored portion of the tub with the plate.

According to another modification in the case of a sink having assembled non-colored tubs on a colored plate, each tub of bare stainless steel is directly fixed by engagement of its peripheral rim at the edge of each opening of the plate, also of bare stainless steel, by electrical welding while the interior surface of the tub is covered by a removable mask. The exterior surface of the plate then receives one or more adherent colored coatings of high abrasion resistance. After hardening of the coatings, a peripheral grinding is effected angularly and tangentially with respect to the exterior rounded connecting surface of the peripheral rim to form a chamfer eliminating all excess metal and the coating at the extremity of the peripheral edge of the opening of the plate and thereby providing a perfect connection of the colored portion of the plate with the bare tub.

According to another modification in the case of a one-piece sink with one or more tubs obtained directly by stamping a plate of stainless steel, the interior of each tub is covered from its opening by a removable mask to allow the exterior surface of the plate to be covered with a colored layer whereafter a slight peripheral grinding is effected tangentially and angularly on the exterior rounded surface to obtain a perfect connection of the colored portion of the plate with each non-colored tub.

According to another modification in the case of a one-piece sink with tubs obtained directly at the time of stamping of a plate of stainless steel, the exterior surface of the plate is covered from the curve of the rim of each sink by a removable mask to allow one or more colored layers to be applied to the interior of the tubs and after hardening of these layers a slight peripheral grinding disposed tangentially and angularly on the rounded interior surface produces a perfect connection of the colored portion of each tub with the non-colored plate.

According to another modification in the case of a sink having non-colored tubs of stainless steel assembled with a colored plate also of stainless steel by the conventional process of crimping, a mask is preferably disposed peripherally at the upper portion of each tub and below the rounded portion formed by the connecting edge of the opening of the plate to permit the application of a layer on the upper surface of the said plate.

According to another modification in the case of a sink having colored tubs of stainless steel assembled with a non-colored plate also of stainless steel, the coating and drying of the interior of the tub is directly and independently effected before the clamping operation without otherwise excluding the possibility of obtaining this coating after clamping by utilization of a mask covering the periphery of the opening of the plate.

According to another modification the colored coating on the stainless steel base is achieved by any appropriate fashion in one or a plurality of layers of the same or different colors to obtain a combination of color with at least one outer layer having properties of suitable hardness and quality of finish.

This coating can advantageously be obtained by a colored epoxy powder which polymerizes when warm or by a paint, lacquer, varnish, or similar product.

DETAILED DESCRIPTION

With reference to FIGS. 2–5 and according to the process of manufacture which is the subject of the present invention and in the case of an assembled sink, a tub 1 of stainless steel is obtained in known manner and includes at its upper edge an external rim 1′ joined to a large rounded portion $1^2$. The plate or paillasse 2 also made of stainless steel is provided, according to the particular case, with one or more openings 2′ corresponding to the number of tubs 1.

Figure 1:
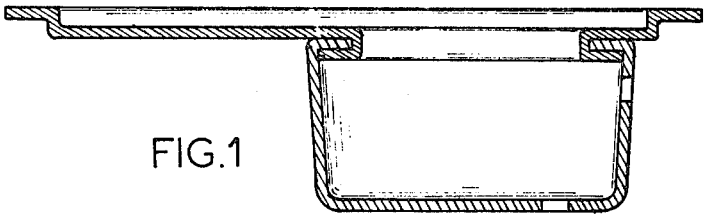
FIG. 1 is a schematic view in longitudinal section of an enameled tub mounted by clamping of its edge on the periphery of the opening of the plate according to the prior art.
Figure 2:
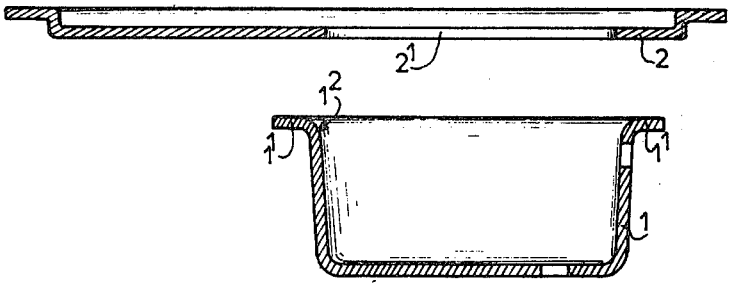
FIGS. 2–5 are schematic views in longitudinal section illustrating successively the different stages of the process of manufacturing sinks of stainless steel with colored tubs according to the invention.
Figure 3:
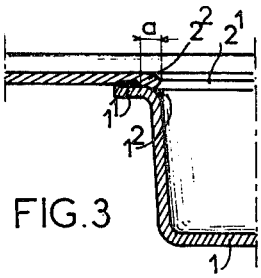
Figure 4:
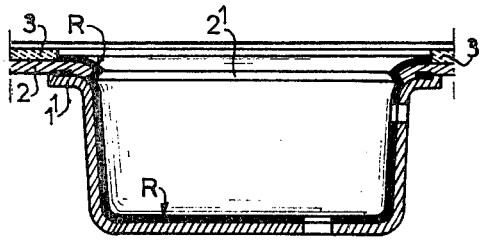

According to FIG. 3 and in a first stage, the external rim 1′ of the tub 1 is axially applied against the lower face of plate 2, at the peripheral edge of the opening 2′ while forming in conformity with the rounded portion $1^2$ a slight peripheral band $2^2$ of the plate along a width a and partially straddling the rounded protion $1_2$. The external rim 1′ is then peripherally welded to the edge of the opening 2′ of the plate 2 by any conventional electrical process to form the connection shown in FIG. 3.

After this welding, achieved through the electrical conductivity of the bare stainless steel of the tub 1 and the plate 2, a peripheral mask 3 is applied by an adhesive or the like on the external surface of the plate 2 slightly displaced from the opening and the interior face of the plate 1 receives, by spraying or the like, a color layer R of great adherence up to the peripheral mask 3.

Figure 5:
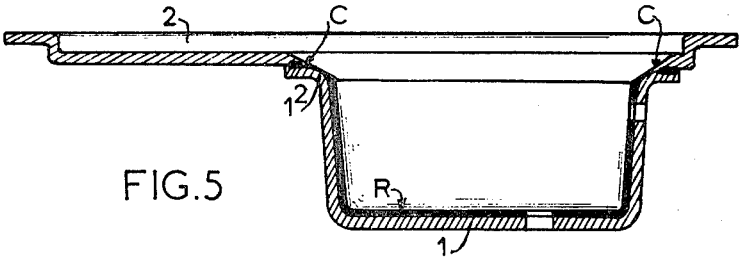
Figure 6:
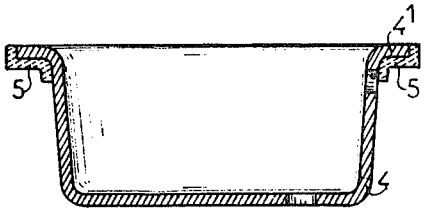
FIGS. 6–10 are schematic views in longitudinal section illustrating successively the different stages of the process of manufacturing sinks of stainless steel with colored tubs according to a modification.

When the layer has hardened, the peripheral mask 3 is removed and a peripheral grinding is effected angularly and tangentially at the rounded portion $1^2$ in a manner to produce a chamfer C which eliminates the slightly rounded portion of the plate 2 as shown in FIG. 5 while forming a perfect connection between the color layer R of the tub 1 in relation to the opening of the plate 2.

Figure 7:
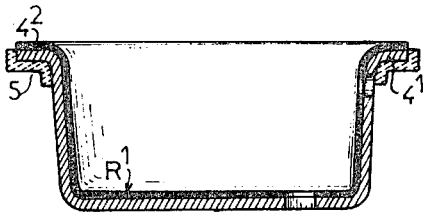
Figure 8:
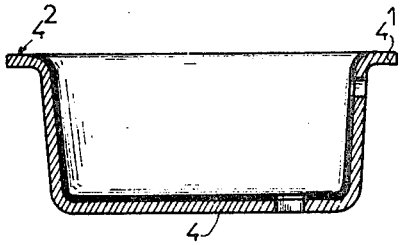

According to the modification illustrated in FIGS. 6–10, the tub 4 of stainless steel receives along its flat rim 4′ a peripheral mask 5 adhered along the flat exterior edges of the rim, whereafter, color layer R′ is applied along the entire interior surface of the tub 4 up to and including the upper surface $4^2$ of the flat rim 4′ as shown in FIG. 7.

After hardening of the layer R′, the color layer R′ at the upper surface $4^2$ of the flat rim 4′ is removed by peripheral grinding (FIG. 8) and its bared surface is degreased and then brought into contact with edge 6′ of the plate 6, also of stainless steel, and, as in the previous embodiment, a slight peripheral band $6^2$ is formed along edge 6′ extending along a width a′ partially straddling the rounded protion of the tub.

Figure 9:
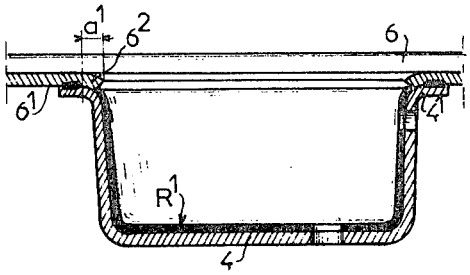
Figure 10:
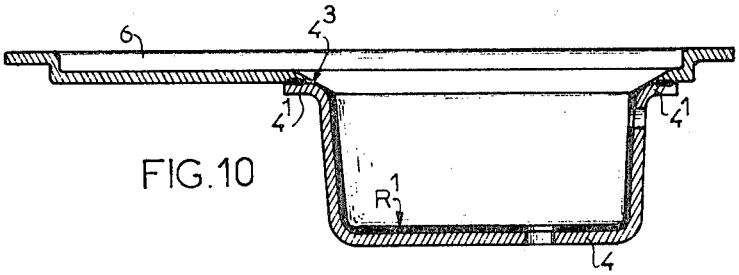
Figure 11:
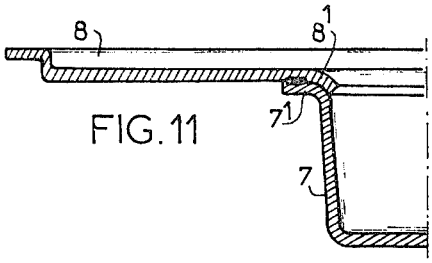
FIGS. 11–14 are schematic views in longitudinal section illustrating successively the different stages for the process of manufacturing stainless steel sinks with colored plates and non-colored tubs according to the invention.
Figure 12:
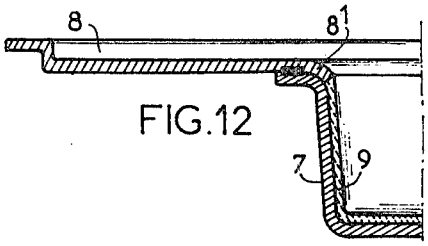
Figure 13:
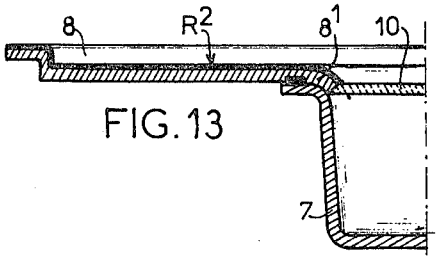

The mask 5 is then removed and a peripheral weld is produced by an electrical process to secure the tub 4 with the plate 6 as shown in FIG. 9. It is then sufficient to effect a peripheral grinding tangentially along the rounded portion $4^3$ of the tub 4 and angularly with respect to the vertical axis of the tub to obtain a perfect connection of the colored layer R′ with respect to the opening of the plate 6.

According to the embodiment illustrated in FIGS. 11–14, in the case of sinks having non-colored assembled tubs and colored plates, the tub 7 of stainless steel is initially fixed by welding its flat rim 7′ to the edge a′ of the plate 8 also of stainless steel, as in the first embodiment, whereafter the interior surface of the tub 7 is covered by a removable mask 9 which can also be in the form of a cover 10 (FIG. 13) up to the peripheral edge a′ of the opening of the plate 6.

Figure 14:
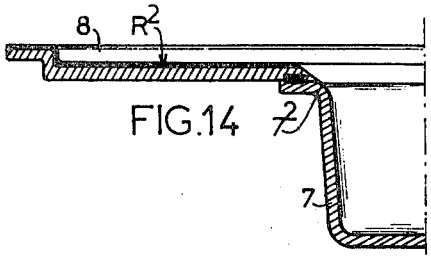

The exterior surface of the plate 8 then receives one or more layers of one or more colored coatings $R_2$ and after hardening, the mask 9 or 10 is removed and a peripheral grinding is effected tangentially at the rounded portion $7^2$ of the tub 7 angularly around the vertical axis of the tub as illustrated in FIG. 14 to thus obtain a perfect connection of the colored layer $R^2$ at the edge of the plate 8 with respect to the opening of the tub 7.

Figure 15:
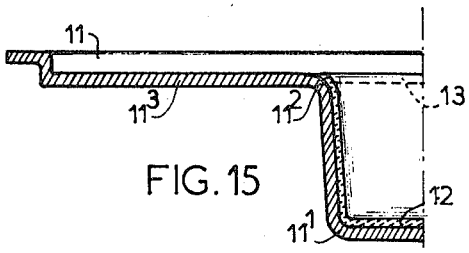
FIGS. 15, 16 and 17 are schematic views in longitudinal section illustrating successively the different stages of the process of manufacture of stainless steel sinks in the case of a one-piece sink with tubs obtained directly at the time of stamping of the plate, the tubs being non-colored while the plate comprises a colored layer.
Figure 16:
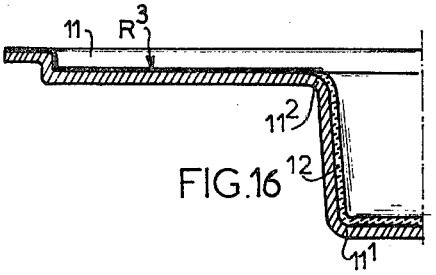
Figure 17:
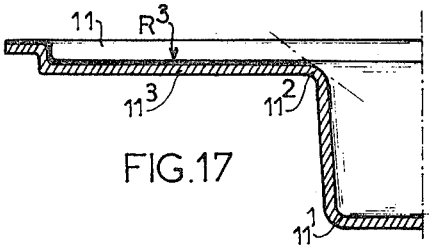

According to the embodiment illustrated in FIGS. 15, 16 and 17 in the case of a one-piece sink of stainless steel with tub 11′ obtained directly at the time of stamping of the plate 11, the tub 11′ is internally covered by a removable mask 12 or by use of a cover 13 up to the edge of the exterior rounded portion $11^2$ to join with the upper planar portion $11^3$. The surface of plate 11 then receives one or more layers of one or more color coatings $R^3$ and, after hardening, the mask 12 or 13 is removed and a light peripheral grinding is effected tangentially and angularly at the rounded portion $11_2$ as shown in FIG. 17 to obtain a precise connection of the coating $R^3$ with respect to the opening of the non-colored tub 11′.

Finally, in the case of a one-piece sink of stainless steel with a tub 14′ obtained directly at the time of stamping of the plate 14, it is also possible according to the invention to obtain a coloration of the tub 14′. It is also possible according to the invention to obtain a coloration of the tub 14′ with respect to the upper planar portion $14^2$ which remains bare.

Figure 18:
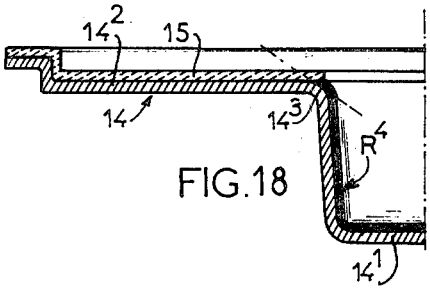
FIG. 18 is a schematic view in longitudinal section illustrating the process for manufacturing sinks of stainless steel in the case of a one-piece sink having tubs obtained directly at the time of stamping of the plate, the plate being non-colored whereas the tubs are colored.

To this effect in FIG. 18 the exterior surface $14^2$ is covered by a removable mask 15 which is slightly peripherally retracted from the rounded portion $14^3$ in a manner to permit formation of one or more color layers $R_4$ on tub 14′. A slight peripheral grinding disposed tangentially at the rounded portion $14^3$ permits, as before, obtaining a precise connection of the layer $R^4$ with respect to the non-colored exterior surface $14^2$.

It is emphasized also that in the case of sinks having non-colored assembled tubs of stainless steel and colored plates also of stainless steel fixed by the known clamping process a mask is preferably disposed peripherally at the upper portion or at the interior of the tub and below the rounded portion formed by the connection of the opening of the plate to allow the application of the coating on the upper surface of the plate. In the opposite case, that is to say, with colored tubs and bare stainless steel plates, the coating of each tub is separately effected before the assembly.

It is obvious that the color coating on the stainless steel can be obtained in one or more layers of the same or different colors and of equal or different hardness but with at least one outer layer having the properties of sufficient hardness and high quality of finish.

By way of example, without limitation, reference is made to the use of a resin or colored epoxy powder which polymerizes when warm without otherwise excluding the use of paints, lacquers, varnishes or similar products.

It is also obvious that the invention is applicable to sinks having one or more tubs of stainless steel assembled by any other means such as riveting.

One can also obtain assembled tubs of material or metal different from the plate and of different colors and texture, for example, copper and stainless steel.

The advantages follow from the description and the following are particularly emphasized:

chipping minimized;

the base is stainless steel which prevents oxidation and therefore the formation of rust in case of slight deterioration of the color layer;

the colored surface is perfectly washable;

absence of peripheral recesses avoiding the accumulation of waste;

the capability of surface removal of the color layer to reconstitute the appearance of the tub or the plate of stainless steel;

the possibility of touch-up.

The invention is not limited only to the embodiments disclosed and embraces all modifications and variations within the scope of the appended claims.

I claim:

1. A process for manufacturing a sink of stainless steel having a tub member connected to a plate member forming a drain board, said process comprising forming said members of stainless steel, coating one of said members with an adherent color layer of abrasion resistant material, the tub member being joined to the plate member along a rounded annular connection region, to which said color layer extends, and tangentially grinding said annular connection region to form a chamfer providing a precise connection between the color layer of said one member and the surface of the other member.

2. A process as claimed in claim 1 comprising connecting the tub member to the plate member by contacting the same along bare surfaces thereof and electrically welding the members together at the contacting surfaces.

3. A process as claimed in claim 2 wherein for producing a colored tub member and a non-colored plate member, the process comprises applying a removable mask to the exterior surface of the plate member slightly retracted with respect to the opening in the tub member and after welding, the color layer is applied to the interior of the tub member.

4. A process as claimed in claim 2 wherein for producing a non-colored tub member and a colored plate member, the process comprises applying a removable mask on the interior surface of the tub member and, after welding, the exterior surface of the plate member is coated with the color layer.

5. A process as claimed in claim 1 wherein the plate member is formed with an opening for receiving the tub member, said opening in the plate member being substantially smaller than the open mouth of the tub member to permit the grinding and thereby the peripheral connection of the plate member with the rounded portion of the tub member and the color layer.

6. A process as claimed in claim 2 wherein the tub member is preliminarily coated on its interior surface with the color layer and after drying is ground to expose the stainless steel base at its upper peripheral rim, said exposed portion being joined to the edge of an opening in the plate member by the electrical welding, said peripheral grinding being effected on a rounded portion at the peripheral rim of the tub member to remove all excess metal at the side of the opening of the plate member while producing the connection with the color layer.

7. A process as claimed in claim 6 comprising applying a removable peripheral mask on the lower face of the peripheral rim of the tub member before the application of the color layer in the interior of said tub member.

8. A process as claimed in claim 1 wherein the sink is a one-piece member in which the tub member is obtained directly from the plate member by a stamping operation, the interior of the tub member being covered from the opening at its mouth by a removable mask to enable application of the color layer on the exterior surface of the plate member and after hardening of the color layer said grinding operation is effected.

9. A process as claimed in claim 1 wherein the sink is a one-piece member in which the tub member is obtained directly from the plate member by a stamping operation, the method comprising covering the exterior surface of the plate from a rounded connection portion with said tub member by a removable mask whereafter the color layer is applied to the interior of the tub member whereafter said grinding is effected on said rounded connection portion to provide connection of the color layer in said tub member with the exterior base surface of the plate member.

10. A process as claimed in claim 1 for producing a sink having a non-colored tub member and a colored plate member secured by a clamped connection, said process comprising covering the interior of the tub member from the mouth opening thereof and below a rounded portion connected to the plate member around an opening therein by a peripheral mask whereafter the color layer is applied to the exterior surface of the plate member.

11. A process as claimed in claim 1 wherein for a sink having an assembled color tub member and a non-colored plate member, said tub member is coated with the color layer in the interior of the tub member directly and independently before the assembly of the tub member with the plate member.

12. A process as claimed in claim 11 after assembling the tub member with the plate member by covering the periphery of said plate member surrounding the open mouth of the tub member with a removable mask.

13. A process as claimed in claim 1 wherein said color layer is formed by one or more layers of the same or different color with at least the outer layer having high hardness and abrasion resistance.

14. A process as claimed in claim 13 wherein said color layer is formed by a polymerizable epoxy resin, paint, varnish or lacquer.

* * * * *